US009782054B2

(12) United States Patent
Dries

(10) Patent No.: US 9,782,054 B2
(45) Date of Patent: Oct. 10, 2017

(54) PUMP ASSEMBLIES AND FLUID CIRCULATION SYSTEMS FOR DISHWASHER APPLIANCES

(71) Applicant: General Electric Company, Schenectady, NY (US)

(72) Inventor: John Edward Dries, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 346 days.

(21) Appl. No.: 14/595,285

(22) Filed: Jan. 13, 2015

(65) Prior Publication Data

US 2016/0198931 A1 Jul. 14, 2016

(51) Int. Cl.

| | |
|---|---|
| ***A47L 15/42*** | (2006.01) |
| ***F04D 13/06*** | (2006.01) |
| ***F04D 29/66*** | (2006.01) |
| ***F04D 29/60*** | (2006.01) |
| ***F04D 29/62*** | (2006.01) |

(52) U.S. Cl.

CPC ..... *A47L 15/4225* (2013.01); *F04D 13/06* (2013.01); *F04D 29/605* (2013.01); *F04D 29/628* (2013.01); *F04D 29/669* (2013.01)

(58) Field of Classification Search

CPC ..... A47L 15/4225

See application file for complete search history.

(56) References Cited

U.S. PATENT DOCUMENTS

| | | | |
|---|---|---|---|
| 4,647,803 | A | 3/1987 | von der Heide et al. |
| 5,619,389 | A | 4/1997 | Dunfield et al. |
| 5,637,938 | A | 6/1997 | Vukorpa et al. |

FOREIGN PATENT DOCUMENTS

| | | | |
|---|---|---|---|
| WO | WO 2006/064860 | A1 | 6/2006 |

*Primary Examiner* — Jason Ko

(74) *Attorney, Agent, or Firm* — Dority & Manning, P.A.

(57) ABSTRACT

Pump assemblies and fluid circulation systems for dishwasher appliances are provided. A pump assembly includes a housing defining an interior, and a pump. The pump includes an impeller disposed within the interior, and a motor connected to the impeller and comprising a stator and a rotor. The rotor is rotatable about a central axis. The stator is rotatable about the central axis relative to the rotor and the housing. The pump further includes an elastic damper coupled to the stator for reducing stator torque ripple transmissions to the housing.

19 Claims, 5 Drawing Sheets

PUMP ASSEMBLIES AND FLUID CIRCULATION SYSTEMS FOR DISHWASHER APPLIANCES

FIELD OF THE INVENTION

The subject matter of the present disclosure relates generally to pump assemblies for use in various applications such as dishwasher appliances, and to fluid circulation systems with improved pump assemblies in dishwasher appliances.

BACKGROUND OF THE INVENTION

Dishwasher appliances generally include a tub that defines a wash compartment. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber. Other configurations may be used as well.

Dishwasher appliances further typically include a fluid circulation system which is in fluid communication with the spray assemblies for circulating fluid to the spray assemblies. The fluid circulation system generally receives fluid from the wash chamber, filters soil from the fluid, and flows the filtered fluid either to the spray assemblies or to a drain. To facilitate the flow of filtered fluid to the spray assemblies and/or drain, a pump is typically included in the fluid circulation system.

One issue with presently known pumps for both dishwasher appliance applications and other applications is torque ripple during operation of the motor driving the impeller of the pump. Torque ripple can transmit undesirable movement to the surrounding housing and other structure. Additionally, torque ripple can increase the noise generated by the motor and pump during operation of the dishwasher appliance.

One conventionally known solution for reducing the negative effects of torque ripple in pumps has involved "isolation", or vibration damping, of the entire motor from other components of the pump. This can undesirably result in inaccurate positioning of the shaft. Another conventionally known solution for reducing the negative effects of torque ripple in pumps has involved isolation of the entire pump (including the motor assembly), which can undesirably require increase in the size and decreases in the efficiency of the pump.

Accordingly, improved pumps, for various applications including uses in dishwasher appliances, are desired in the art. In particular, pumps having reduced negative effects of torque ripple which can additionally provide relatively accurate shaft placement, reduced size, and improved efficiency would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a pump assembly is provided. The pump assembly includes a housing defining an interior, and a pump. The pump includes an impeller disposed within the interior, and a motor connected to the impeller and comprising a stator and a rotor. The rotor is rotatable about a central axis. The stator is rotatable about the central axis relative to the rotor and the housing. The pump further includes an elastic damper coupled to the stator for reducing stator torque ripple transmissions to the housing.

In accordance with another embodiment, a fluid circulation system for a dishwasher appliance is provided. The dishwasher appliance includes a tub that defines a wash chamber. The fluid circulation system includes a sump for receiving fluid from the wash chamber, the sump including a housing having a sidewall and a base wall and defining an interior. The fluid circulation system further includes a pump. The pump includes an impeller disposed within the interior, and a motor connected to the impeller and comprising a stator and a rotor. The rotor is rotatable about a central axis. The stator is rotatable about the central axis relative to the rotor and the housing. The pump further includes an elastic damper coupled to the stator for reducing stator torque ripple transmissions to the housing.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures, in which.

DETAILED DESCRIPTION OF THE INVENTION

Figure 1:
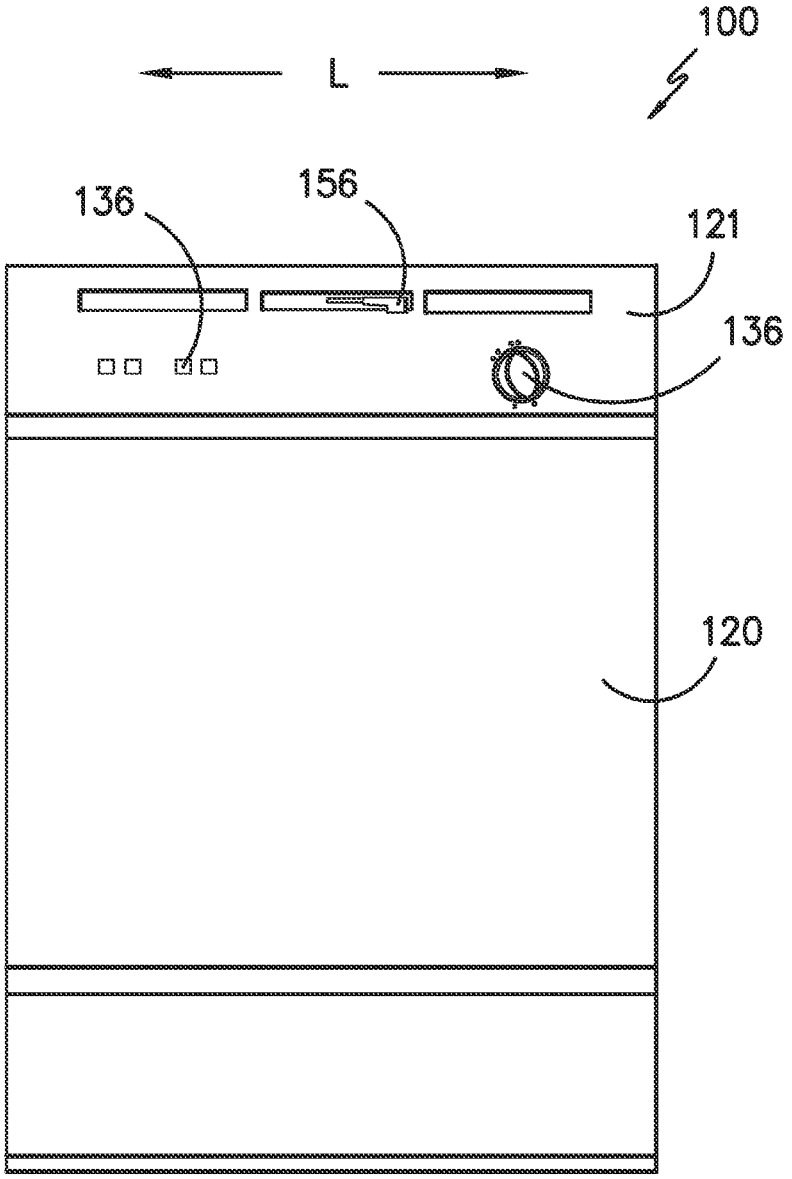
FIG. 1 provides a front view of an exemplary embodiment of a dishwasher appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

Figure 2:
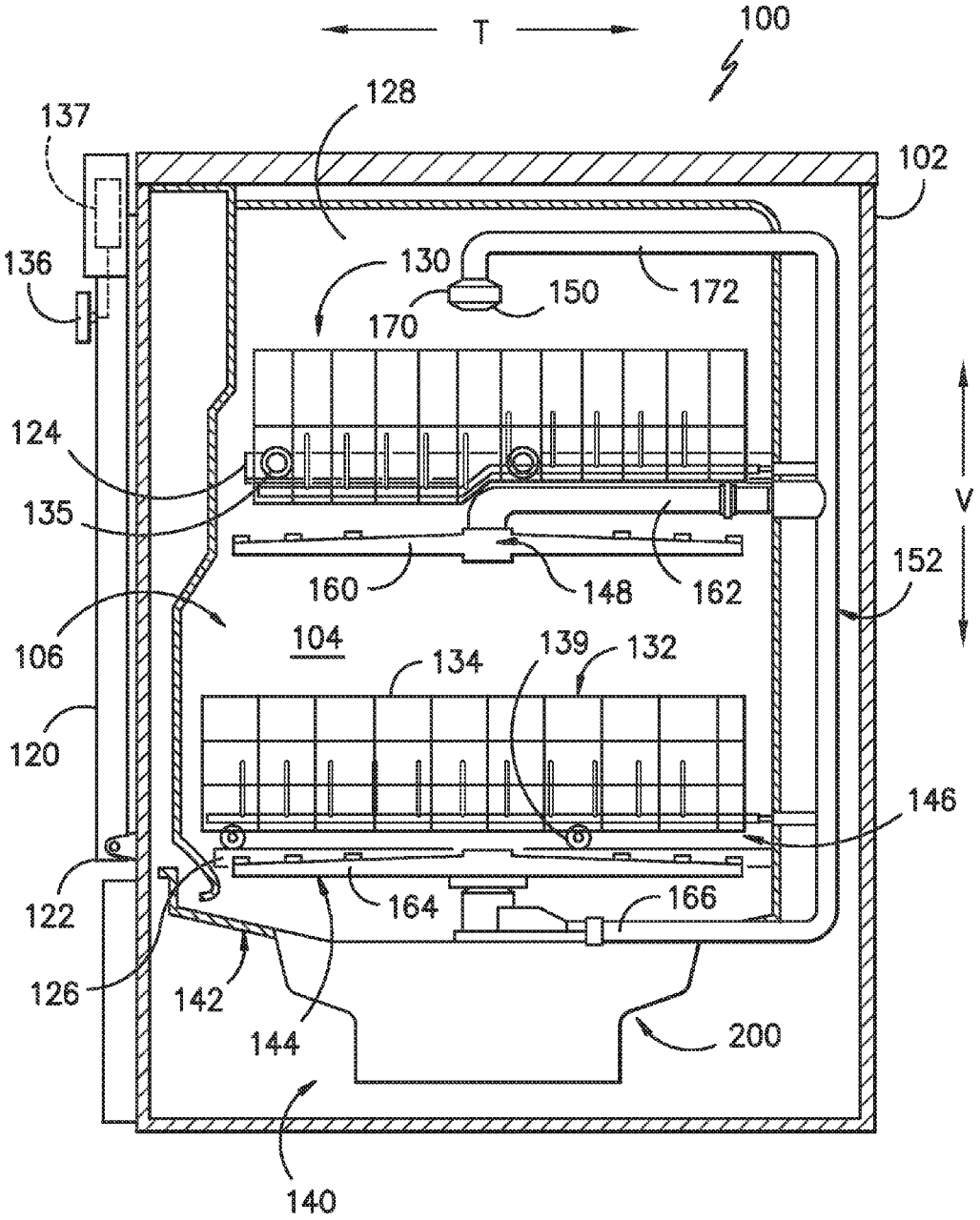
FIG. 2 provides a side, cross-sectional view of the exemplary dishwasher appliance of FIG. 1.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. As shown, the dishwasher appliance 100 (such as the cabinet 102 thereof) defines a vertical direction V, a lateral direction L, and a transverse direction T, which are mutually orthogonal and define a coordinate system for the dishwasher appliance. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. A latch 156 may be used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a bottom wall 142 of the tub 104 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

Each spray arm-assembly 144 may include a spray arm and a conduit in fluid communication with the spray arm, for providing a fluid flow to the spray arm. For example, mid-level spray-arm assembly 148 may include a spray arm 160 and a conduit 162. Lower spray-arm assembly 144 may include a spray arm 164 and a conduit 166. Additionally, upper spray assembly 150 may include a spray head 170 and a conduit 172 in fluid communication with the spray head 170.

The lower and mid-level spray-arm assemblies 144, 148 and the upper spray assembly 150 are part of a fluid circulation system 152 for circulating fluid in the dishwasher appliance 100. The fluid circulation system 152 also includes various components for receiving fluid from the wash chamber 106, filtering the fluid, and flowing the fluid to the various spray assemblies such as the lower and mid-level spray-arm assemblies 144, 148 and the upper spray assembly 150. As discussed herein such components can be generally positioned within a machinery compartment 140 below the bottom wall 142 and in communication with the wash chamber 106.

The dishwasher appliance 100 is further equipped with a controller 137 to regulate operation of the dishwasher appliance 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, different combinations of spray assemblies may be utilized, and other differences may be applied as well.

Referring now to FIGS. 2 through 5, various embodiments of portions of the fluid circulation system 152 of a dishwasher appliance 100 are illustrated. As shown, system 152 may include, for example, a sump 200 for receiving fluid from the wash chamber 106. The sump 200 may be mounted to the bottom wall 142 and extend into the machinery compartment 140, and fluid may for example flow from the bottom wall 142 into the sump 200.

Figure 4:
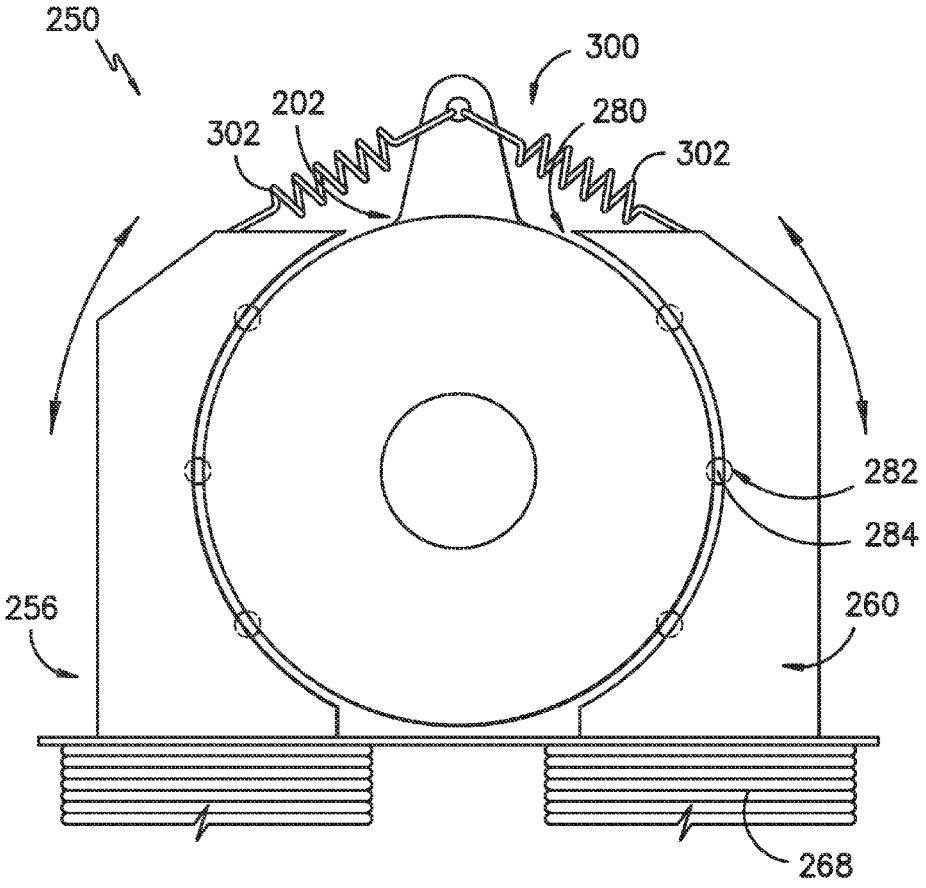
FIG. 4 provides a bottom view of the fluid circulation system of FIG. 3.

Sump 200 may include, for example, a housing 202 which receives the fluid from the wash chamber 106. As illustrated, housing 202 may include a sidewall 206 and a base wall 208. The sidewall 206 may extend from the base wall 208. In exemplary embodiments, the sidewall 208 may have a generally circular cross-sectional shape, as illustrated in FIG. 4. The sidewall 206 and base wall 208 may define an interior 204 of the housing 202, in which fluid may collect during operation of the dishwasher appliance 100.

System 152 may further include an outlet conduit (not shown). The outlet conduit flows fluid from the sump 200, such as from the housing 202 thereof, back to the wash chamber 106 as desired. For example, the outlet conduit may be in fluid communication with the various spray assemblies, such as the lower and mid-level spray-arm assemblies 144, 148 and the upper spray assembly 150, such that fluid flowed into the outlet conduit can flow to these spray assemblies. Fluid circulation system 152 may additionally include one or more filters (not shown). The filters may generally remove soil from the fluid that flow into the sump 200 before the fluid is flowed from the sump 200 through the outlet conduit.

As discussed above, improved pumps for various applications including in dishwasher appliances are desired. According, and referring still to FIGS. 3 through 5, various embodiments of a pump assembly 250 in accordance with the present disclosure are provided. Notably, in the embodiments illustrated in FIGS. 3 through 4, the components of the pump assembly 250 are utilized in a dishwasher appliance 100, such as in the fluid circulation system 152 thereof. It should be understood, however, that the present disclosure is not limited to pump assemblies 200 in fluid circulation systems 152 of dishwasher appliances 100. Rather, the use of pump assemblies 250 in accordance with the present disclosure in any suitable applications is within the scope and sprit of the present disclosure.

Pump assembly 250 includes a housing defining an interior. In the embodiments illustrated, the housing is housing 202 of the sump 200 of a fluid circulation system 152 for a dishwasher appliance 100. Housing 202 includes an interior 204. Alternatively, however, any suitable housing which defines an interior in or to which a fluid is flowed is within the scope and spirit of the present disclosure. For purposes of reference to the Figures, the housing and interior of the pump assembly 250 will be referred to herein as housing 202 and interior 204.

Pump assembly 250 further includes a pump 252. The pump 252 is generally operable to urge and direct the flow of fluid within the interior 204. Pump 252 may, for example, include an impeller 254. The impeller 254 may be disposed within the interior 204 of the housing 202, and may rotate within the interior 204 when activated to influence the flow of fluid within the interior 204. Pump 252 may further include a motor 256 which is connected to the impeller 254. For example, a shaft 258 may extend between and connect the motor 256 and the impeller 254. Operation of the motor 256 may rotate the impeller 254.

As illustrated, motor 256 includes a stator 260 and a rotor 262. As is generally understood, the rotor 262 rotates, such as about a central axis 264 (which may be defined by the longitudinal axis of the shaft 258), relative to the stator 260 during operation of the motor 256. In some embodiments as illustrated, the motor 256 is a "wet rotor" type permanent magnet synchronous motor, with a non-magnetic barrier (the housing 202) disposed between the stator 260 and rotor 262. As shown, stator 260 may for example include a plurality of stator laminations 266 and associated stator windings 268. Rotor 262 may include one or more permanent magnets (not shown). Alternatively, however, motor 256 could be an induction motor, other permanent magnet synchronous motor, or other suitable motor 256 that utilizes a stator and rotor.

In some embodiments, as illustrated, the stator 260 may be disposed exterior to the housing 202, while the rotor 262 is disposed within the housing 202 (in the interior 204). Alternatively, however, stator 260 and rotor 262 may both be disposed within the housing 202 (in the interior 204). Further, as shown, housing 202 may in some embodiments include a wet portion 270 and a dry portion 272. Fluid may flow into the wet portion 270 but partitioned from the dry portion 272 by a bulkhead 274. The rotor 262 (and in some embodiments the stator 260) may be disposed within the dry portion 272, and the shaft 258 may extend through the bulkhead 274 to connect with the impeller 254 which is disposed within the wet portion 270. Alternatively, the entire interior 204 may be considered wet, with no dry portion and fluid flowable into the entire interior 204. The rotor 262 (and in some embodiments the stator 260) may be disposed within the interior 204, may for example be hermetically sealed to prevent damage thereto from fluids within the interior 204.

Figure 3:
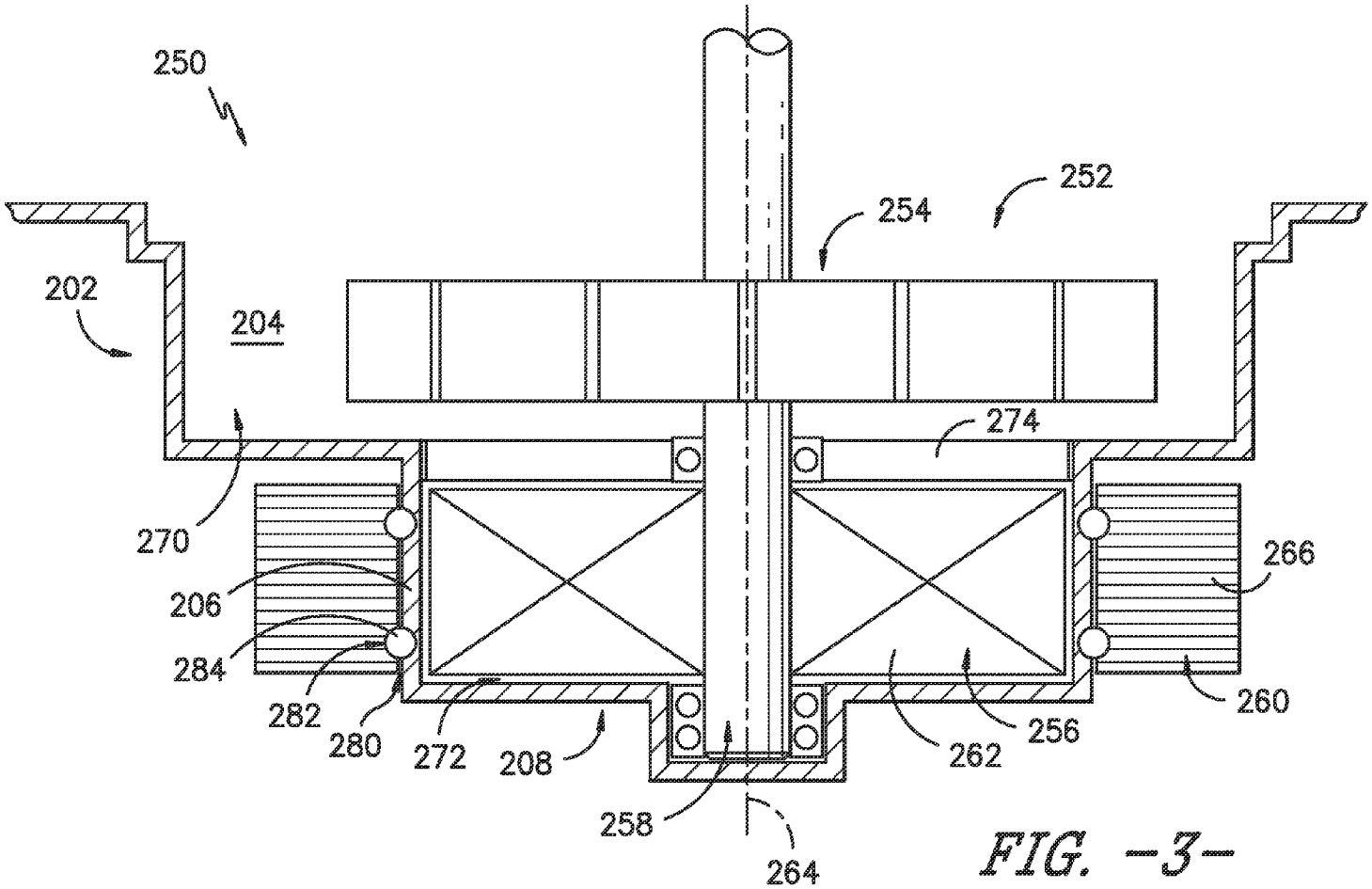
FIG. 3 provides a side, cross-sectional view of a fluid circulation system for a dishwasher appliance in accordance with one embodiment of the present disclosure.
Figure 5:
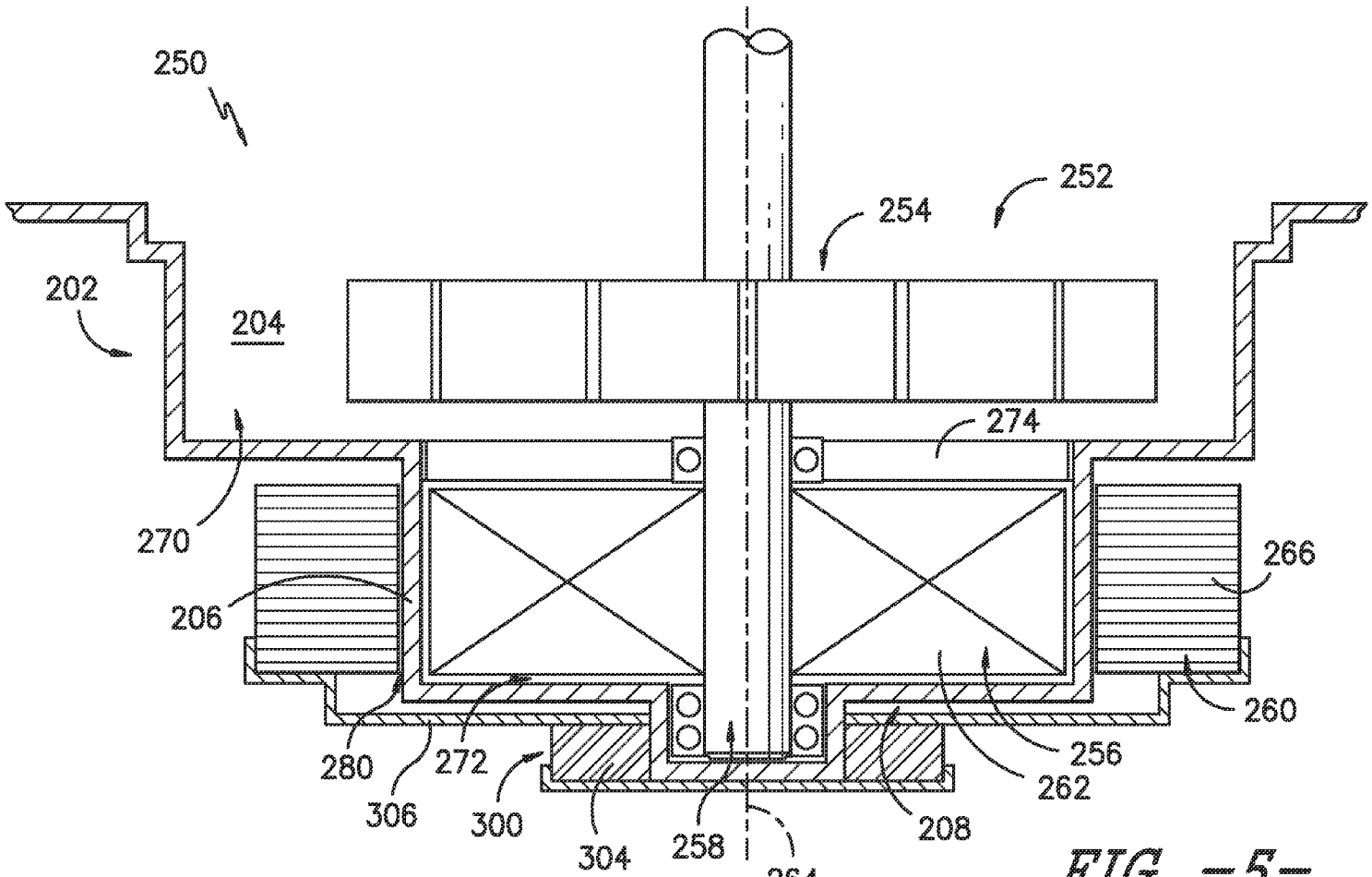
FIG. 5 provides a side, cross-sectional view of a fluid circulation system for a dishwasher appliance in accordance with another embodiment of the present disclosure.

As further illustrated in FIGS. 3 through 5, stator 260 may be spaced from the housing 202 (such as from the sidewall 206 thereof). Such spacing defines a gap 280 between the stator 260 and the housing 202. Friction between the housing 202 and the stator 260 due to movement of the stator 260 during operation of the pump assembly 250 (as discussed herein) is thus reduced or eliminated. In some embodiments, as shown in FIG. 5, there is no interaction between the stator 260 and housing 202, and the friction is eliminated. In these embodiments, the gap 280 is constant. In other embodiment, as shown in FIGS. 3 and 4, a bearing assembly 282 may be disposed between the stator 260 and housing 202 in the gap 280. Bearing assembly 282 may for example include a plurality of ball bearings 284 or other suitable bearing components. The bearing assembly 282 may guide rotation of the stator 260 relative to the housing 202, and the friction therebetween may be reduced due to the bearing assembly 282.

As mentioned, stator 260 may additionally be rotatable. Specifically, stator 260 may be rotatable relative to the rotor 262 and the housing 202, such as about the central axis 264. Allowing the stator 260 to be rotatable relative to the rotor 262 and housing 202 advantageously reduces transmission of torque ripple from the stator 260 to the rotor 262, housing 202, etc. during operation by generally isolating the stator 260 from rotor 262 and housing 202. Further, such rotation of the stator 260 may advantageously be dampened and optionally restrained. Such dampening further reduces the transmission of torque ripple. Such configurations, generally isolating and damping the stator 260 while not requiring damping and/or isolation of the entire motor or pump, advantageously allow for effective reduction in the negative effects of torque ripple while also allowing relatively accurate shaft placement, reduced size pump, and improved pump efficiency.

Accordingly, and as illustrated in FIGS. 3 through 5, pump 252 may further include an elastic damper 300. The damper 300 may be coupled to the stator 260, and may reduce stator torque ripple transmission to the housing 202. For example, in some embodiments, as illustrated in FIGS. 3 and 4, the elastic damper 300 may include one or more springs 302. The spring(s) 302 may be connected to the stator 260 to dampen and restrict movement (and in particular rotation) of the stator 260 during operation of the motor 256. In some embodiments as illustrates, a spring 302 may be a coil spring. Alternatively, however, any suitable springs may be utilized. A spring 302 may, for example, be connected to and between the stator 260 and the housing 202 to dampen and restrict movement of the stator 260.

In other embodiments, as illustrated in FIG. 5, the elastic damper 300 may include a bushing 304, which in exemplary embodiments may be an elastomeric bushing. Any suitable elastomers, including rubbers such as unsaturated and saturated rubbers, may be utilized. In some embodiments, the stator 260 may directly contact the bushing 304 such that movement of the stator 260 is dampened by the bushing 304. In other embodiments, an intermediate component may transmit forces generated by the stator 260 to the bushing 304. For example, a support plate 306 may be disposed between the stator 260 and the bushing 304. The stator 260 may contact the support plate 306, and the support plate 306 may contact the bushing 304. Plate 306 may be fastened to the stator 260 such that the plate 306 is rotatable with the stator 260, or the stator 260 may rotate relative to the plate 306. In either case, bushing 304 may dampen the stator 260 during operation of the motor 256.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A pump assembly, the pump assembly comprising:
a housing defining an interior; and
a pump, the pump comprising:
an impeller disposed within the interior;
a motor connected to the impeller and comprising a stator and a rotor, the rotor rotatable about a central axis, the stator rotatable about the central axis relative to the rotor and the housing; and
an elastic damper coupled to the stator for reducing stator torque ripple transmissions to the housing.

2. The pump assembly of claim 1, wherein the stator is disposed exterior to the housing and the rotor is disposed within the housing.

3. The pump assembly of claim 1, wherein the stator is spaced from the housing such that a gap is defined therebetween.

4. The pump assembly of claim 1, wherein the pump further comprises a bearing assembly disposed between the stator and the housing.

5. The pump assembly of claim 1, wherein the elastic damper comprises a spring.

6. The pump assembly of claim 5, wherein the spring is a coil spring.

7. The pump assembly of claim 5, wherein the spring is connected to and between the stator and the housing.

8. The pump assembly of claim 1, wherein the elastic damper comprises an elastomeric bushing.

9. The pump assembly of claim 8, wherein the pump further comprises a support plate disposed between the stator and the elastomeric bushing.

10. A fluid circulation system for a dishwasher appliance, the dishwasher appliance comprising a tub that defines a wash chamber, the fluid circulation system comprising:
a sump for receiving fluid from the wash chamber, the sump comprising a housing having a sidewall and a base wall and defining an interior;
a pump, the pump comprising:
an impeller disposed within the interior;
a motor connected to the impeller and comprising a stator and a rotor, the rotor rotatable about a central axis, the stator rotatable about the central axis relative to the rotor and the housing; and
an elastic damper coupled to the stator for reducing stator torque ripple transmissions to the housing.

11. The fluid circulation system of claim 10, wherein the stator is disposed exterior to the housing and the rotor is disposed within the housing.

12. The fluid circulation system of claim 10, wherein the stator is spaced from the housing such that a gap is defined therebetween.

13. The fluid circulation system of claim 10, wherein the pump further comprises a bearing assembly disposed between the stator and the housing.

14. The fluid circulation system of claim 10, wherein the elastic damper comprises a spring.

15. The fluid circulation system of claim 14, wherein the spring is a coil spring.

16. The fluid circulation system of claim 14, wherein the spring is connected to and between the stator and the housing.

17. The fluid circulation system of claim 10, wherein the elastic damper comprises an elastomeric bushing.

18. The fluid circulation system of claim 17, wherein the pump further comprises a support plate disposed between the stator and the elastomeric bushing.

19. The fluid circulation system of claim 10, further comprising an outlet conduit at least partially surrounding the impeller.

* * * * *